US010962026B2

(12) United States Patent
Mochizuki et al.

(10) Patent No.: US 10,962,026 B2
(45) Date of Patent: Mar. 30, 2021

(54) WATERPROOF COVER

(71) Applicant: AISIN SEIKI KABUSHIKI KAISHA, Kariya (JP)

(72) Inventors: Kentaro Mochizuki, Nagoya (JP); Shuji Hattori, Nagoya (JP)

(73) Assignee: AISIN SEIKI KABUSHIKI KAISHA, Kariya (JP)

( * ) Notice: Subject to any disclaimer, the term of this patent is extended or adjusted under 35 U.S.C. 154(b) by 456 days.

(21) Appl. No.: 15/928,637

(22) Filed: Mar. 22, 2018

(65) Prior Publication Data

US 2018/0283405 A1 Oct. 4, 2018

(30) Foreign Application Priority Data

Mar. 28, 2017 (JP) ..... JP2017-062863

(51) Int. Cl.

| | |
|---|---|
| ***F04D 29/70*** | (2006.01) |
| ***F04D 29/42*** | (2006.01) |
| ***F04D 25/06*** | (2006.01) |
| ***F04D 1/00*** | (2006.01) |
| ***F04D 13/06*** | (2006.01) |

(52) U.S. Cl.

CPC ..... *F04D 29/708* (2013.01); *F04D 1/00* (2013.01); *F04D 13/0686* (2013.01); *F04D 25/06* (2013.01); *F04D 29/426* (2013.01)

(58) Field of Classification Search

None

See application file for complete search history.

(56) References Cited

U.S. PATENT DOCUMENTS

2014/0294631 A1* 10/2014 Kanazawa ..... F04D 29/126 417/421
2015/0071796 A1* 3/2015 Yoshioka ..... F04D 29/58 417/410.1
2016/0146225 A1* 5/2016 Park ..... F04D 13/08 415/116

(Continued)

FOREIGN PATENT DOCUMENTS

| | | |
|---|---|---|
| JP | 2006-332699 A | 12/2006 |
| JP | 2013-87636 A | 5/2013 |
| JP | 2017-34880 | 2/2017 |

OTHER PUBLICATIONS

Japanese Office Action issued in Japanese Patent Application No. 2017-062863 on Dec. 15, 2020, citing documents AO-AP therein (w/ English Translation).

*Primary Examiner* — Christopher P Jones
*Assistant Examiner* — Brit E. Anbacht
(74) *Attorney, Agent, or Firm* — Oblon, McClelland, Maier & Neustadt, L.L.P.

(57) ABSTRACT

A waterproof cover includes: a lid unit having a vent hole which allows an inner surface and an outer surface to communicate with each other, and configured to cover an electronic component; and a filter fixed to the inner surface of the lid unit in a state of facing an inner open end portion of the vent hole, and configured to block flow of a liquid while allowing air to flow therethrough, in which the outer surface of the lid unit has a surface area including a surface in which an outer open end portion of the vent hole is exposed, and the surface area has a region formed at a position adjacent to the vent hole and having a height different from a height of the surface.

4 Claims, 4 Drawing Sheets

(56) References Cited

U.S. PATENT DOCUMENTS

2017/0234754 A1* 8/2017 Tanaka ..... B81C 1/00333
73/706
2018/0022063 A1* 1/2018 Berrang ..... B32B 3/30
442/224

* cited by examiner

WATERPROOF COVER

CROSS REFERENCE TO RELATED APPLICATIONS

This application is based on and claims priority under 35 U.S.C. § 119 to Japanese Patent Application 2017-062863, filed on Mar. 28, 2017, the entire contents of which are incorporated herein by reference.

TECHNICAL FIELD

This disclosure relates to a waterproof cover including a lid unit having a vent hole, which allows an inner surface and an outer surface of the lid unit to communicate with each other, and a filter, which blocks the flow of a liquid while allowing air to flow therethrough.

BACKGROUND DISCUSSION

A waterproof cover, which closes a space in which a board for driving an electric pump is accommodated, has a risk of being damaged when the expansion and shrinkage stress of air acts on a lid unit due to a sudden change in temperature within the space, and there is concern about the introduction of water (liquid) from a damaged region.

Thus, there has been known a technology known in which a straight-shaped vent hole (a breathing hole in the document) is provided from the outer surface to the inner surface of a lid unit (a cover in the document) as a conventional waterproof cover, which covers a board, and a filter is attached to the inner surface of the lid unit in a state of facing the inner open end portion of the vent hole (see, e.g., JP 2017-034880 A (Reference 1)). The filter has a characteristic of blocking the flow of a liquid while allowing air to flow therethrough. By this, damage to the lid unit is prevented and the introduction of a liquid to the inside of the lid unit is blocked by maintaining the inside and the outside of the lid unit at the same pressure.

However, the waterproof cover for the electric pump, which is mounted on a vehicle, is often disposed in a state of being exposed to the outside, and the liquid splashed from the road surface may directly hit the lid unit. At this time, in a structure provided with a straight-shaped vent hole as in the waterproof cover of Reference 1, the splashed liquid may be directly introduced into the vent hole, causing a high water pressure to act on the filter, and there is a risk of the filter being damaged by the water pressure. As a result, the liquid is brought into contact with electronic components on the board located inside the lid unit, which causes a breakdown of the electric pump.

Meanwhile, although it is conceivable to assemble a separate component, which covers the vent hole, to the outer surface side of the lid unit in order to prevent a liquid from being introduced into the separate component, this increases manufacturing costs and also increases the size of the electric pump.

Thus, a need exists for a waterproof cover which is not susceptible to the drawback mentioned above.

SUMMARY

A feature of a configuration of a waterproof cover according to an aspect of this disclosure resides in that the waterproof cover includes a lid unit having a vent hole which allows an inner surface and an outer surface to communicate with each other, and configured to cover an electronic component; and a filter fixed to the inner surface of the lid unit in a state of facing an inner open end portion of the vent hole, and configured to block flow of a liquid while allowing air to flow therethrough. The outer surface of the lid unit has a surface area including a surface in which an outer open end portion of the vent hole is exposed, and the surface area has a region formed at a position adjacent to the vent hole and having a height different from a height of the surface.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments of a waterproof cover disclosed here will be described with reference to the drawings. In the present embodiment, an example of a waterproof cover including a lid case 1*b* (an example of a lid unit), which covers a circuit board 6 of an electric pump P configured by a water pump, will be described. However, this disclosure is not limited to the following embodiments, and various modifications are possible without departing from the gist of this disclosure.

<Basic Configuration>

Figure 1:
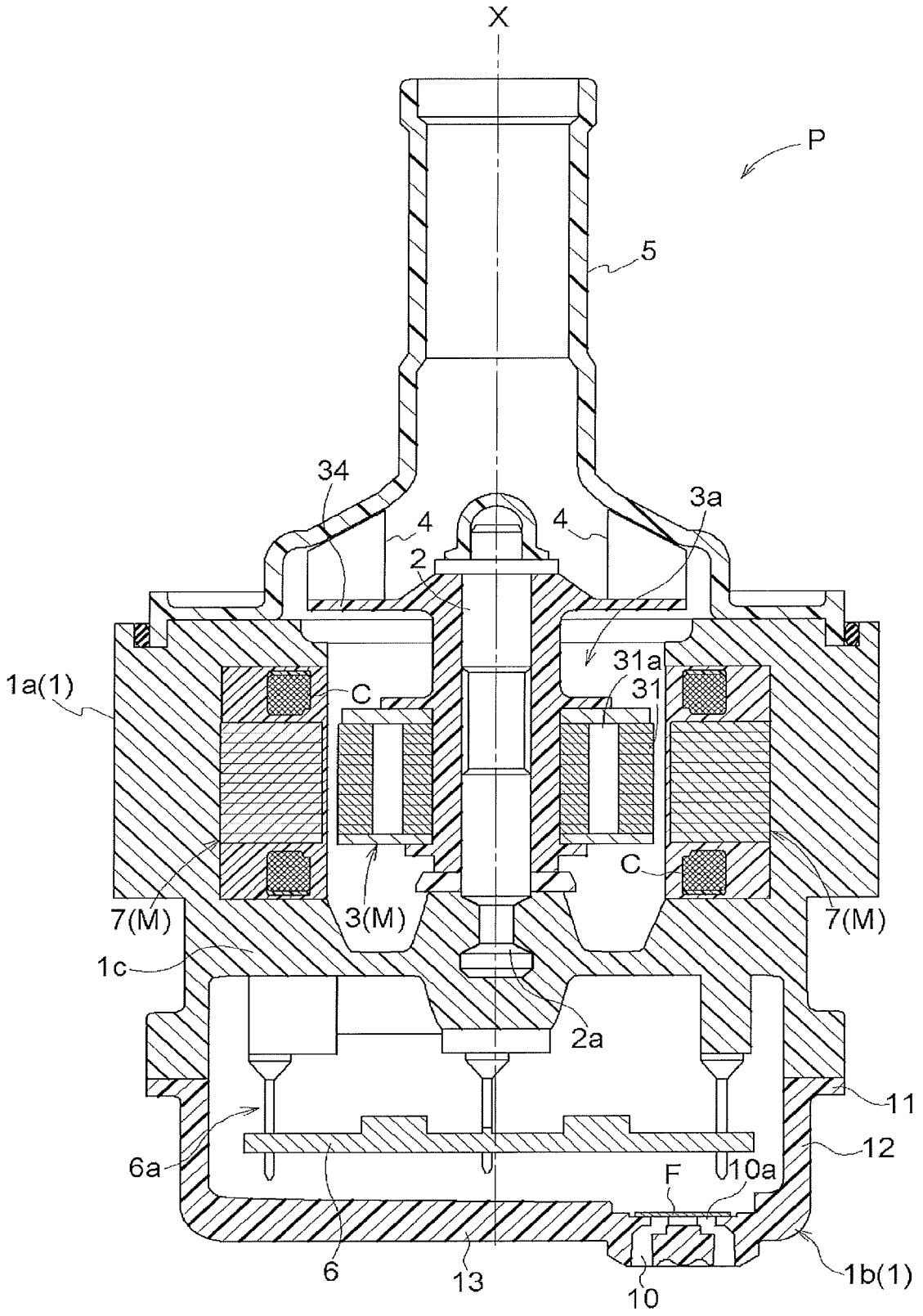
FIG. 1 is a cross-sectional view of a water pump.

As illustrated in FIG. 1, the electric pump P includes a casing 1, a shaft member 2 having one end 2*a* supported by the casing 1, a rotor 3 provided on the outer peripheral side of the shaft member 2 so as to rotate about the rotational axis X, an impeller 4 fixed to a flange-shaped tip end portion 34 of the rotor 3, and an impeller housing 5 in which the impeller 4 is accommodated. The other end of the shaft member 2 is supported by the impeller housing 5. The electric pump P is configured such that the impeller 4 suctions and discharges cooling water as the rotor 3 is rotated by the driving force of an electric motor M. For example, the electric pump P circulates the cooling water to an inverter, or circulates the cooling water between an engine and a radiator. In the present embodiment, the electric motor M is configured with a three-phase brushless motor, which includes the rotor 3 configured to rotate around the rotational axis X and a stator 7 configured to generate a magnetic flux with respect to the rotor 3.

The casing 1 includes a resin motor housing 1*a*, which forms a rotor chamber 3*a* in which the rotor 3 is rotatably accommodated, and the resin lid case 1*b* (an example of a lid unit), which forms a driver chamber 6*a* in which the circuit board 6 (an example of an electronic component), which drives the electric motor M, is accommodated. The motor housing 1*a* has a partition wall 1*c* integrally formed therein so as to separate the rotor chamber 3*a* and the driver chamber 6*a* from each other. The end 2*a* of the shaft member 2 is fixed to the partition wall 1*c* in an insert-molded state. In addition, the stator 7, which is disposed so as to surround the radial outer side of the rotor 3, is insert-molded in the motor housing 1*a*.

The rotor 3 includes an annular rotor core 31 formed by stacking a plurality of magnetic steel plates, and a plurality of permanent magnets 31*a* buried in the rotor core 31. The rotor core 31 and the permanent magnets 31*a* are insert-molded with a resin, and are integrated with each other. In the present embodiment, a permanent magnet 3*b* is configured to have six poles, and the electric motor M is of a six-pole, three-phase, and nine-slot type. In addition, a plurality of inclined grooves (not illustrated), which are inclined in the peripheral direction, are formed in the tip end portion 34 of the rotor 3, and the impeller 4 is fixed to the inclined grooves through vibration welding or the like.

In the present embodiment, the control of current to a coil C, which is wound around the stator 7 via the circuit board 6, is executed by an engine control unit (ECU) of a vehicle (not illustrated), whereby the rotor 3 is rotated by the alternating magnetic field acting on the permanent magnets 31*a*. When the rotor 3 rotates, the impeller 4 fixed to the tip end portion 34 of the rotor 3 also rotates. The impeller 4 is covered with the resin impeller housing 5.

Incidentally, when the electric pump P is mounted on the vehicle, the lid case 1*b* is often disposed in a state of being exposed to the outside, and the lid case 1*b* is sometimes directly hit by water (an example of a liquid). Therefore, the lid case 1*b* is fixed to the motor housing 1*a* in a sealed form in a state of covering the circuit board 6. A method of fixing the lid case 1*b* and the motor housing 1*a* to each other is not particularly limited, and a fixing method having waterproofness such as screwing with a seal member interposed therebetween, thermal welding, vibration welding, or the like is used. Meanwhile, when the driver chamber 6*a* is sealed in order to ensure waterproofness, for example, the expansion and shrinkage stress of air may act on the lid case 1*b* due to a sudden change in the temperature of the circuit board 6, and thus there is risk of the lid case 1*b* of being damaged. In order to prevent this, a plurality of vent holes 10 are provided in the lid case 1*b*, and the driver chamber 6*a* (the inside of the lid case 1*b*) is maintained at the atmospheric pressure.

In addition, the waterproof cover includes a filter F, which is fixed to the inner surface of the lid case 1*b* in a state of facing an inner open end portion 10*a* (the end portion on the driver chamber 6*a* side) of the vent hole 10. The filter F is configured by, for example, a vent filter, which blocks the flow of water while allowing air to flow therethrough. This prevents the water from being introduced into the driver chamber 6*a* from the vent hole 10. In the present embodiment, the filter F is fixed to the lid case 1*b* by thermally welding the outer peripheral portion of the filter F to the inner surface of the lid case 1*b*.

First Embodiment

Figure 2:
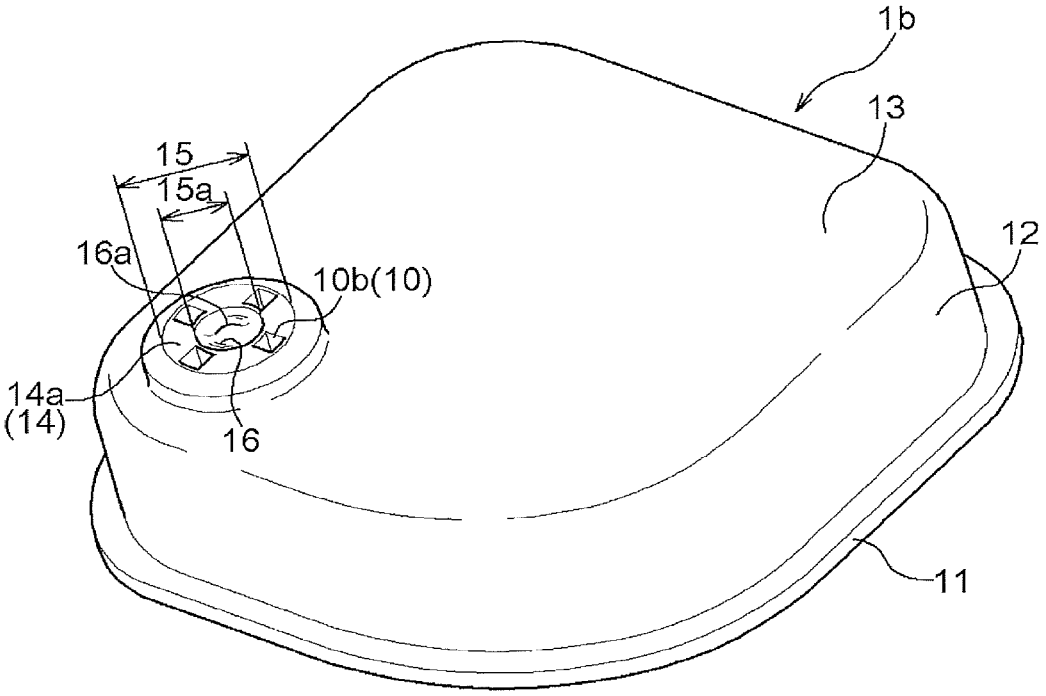
FIG. 2 is a perspective view of a waterproof cover according to a first embodiment.
Figure 3:
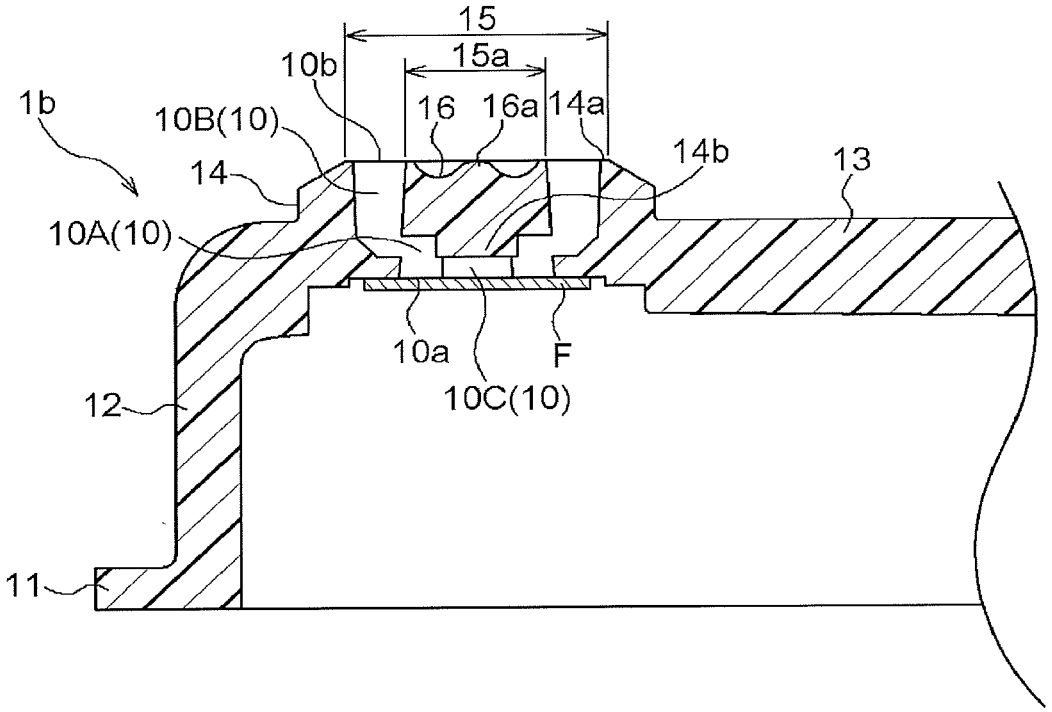
FIG. 3 is an enlarged cross-sectional view of the waterproof cover according to the first embodiment.

A waterproof cover according to a first embodiment will be described with reference to FIGS. 2 to 4. As illustrated in FIGS. 2 and 3, the lid case 1*b* includes a flange portion 11 fixed to the motor housing 1*a*, an annular erected portion 12 vertically erected from the flange portion 11, and a top plate portion 13 having a rectangular shape when viewed in a plane extending inward from the erected portion 12. The top plate portion 13 has a columnar portion 14, which is formed to protrude outward in a columnar shape, and the columnar portion 14 has the plurality of vent holes 10 (in the present embodiment, at four equidistant positions in the peripheral direction), which are formed to penetrate to the back surface of the columnar portion 14. The vent holes 10 allow the outer surface and the inner surface of the lid case 1*b* (the columnar portion 14) to communicate with each other.

In addition, a surface area 15, which includes a surface 14*a* (the same plane as the outer open end portions 10*b* of the vent holes 10) in which the outer open end portions 10*b* (the end portion on the outer side) are exposed, is formed on the outermost surface of the columnar portion 14. Here, the surface 14*a* refers to a plane continuing to the outer open end portions 10*b* of the vent holes 10, but this plane may include a slightly curved surface or the like. In addition, a convex portion 14*b* is formed on the back surface of the columnar portion 14 so as to protrude inward (see FIG. 3). In addition, the columnar portion 14, which protrudes outward in a columnar shape, may protrude in a polygonal columnar shape, or may be configured by the same plane as the top plate portion 13, rather than protruding. In addition, the top plate portion 13 is not limited to a rectangular shape in a plan view, and may have any shape such as a circular shape in a plan view.

The surface area 15 has a region, which is formed at a position adjacent to the outer open end portions 10*b* of the vent holes 10 and has a height different from that of the surface 14*a*. In the present embodiment, the region having the different height is configured by a concave portion 16, which is recessed in a curved shape in a portion of the surface 14*a*. The concave portion 16 is disposed in a central area 15*a* surrounded by the outer open end portions 10*b* of the plurality of vent holes 10, and a protrusion 16*a* having an arc surface is formed in the central portion of the concave portion 16 so as to protrude outward. In other words, the plurality of vent holes 10 are disposed along the outer periphery of the concave portion 16. In addition, the concave portion 16 may not be formed to have a curved shape, but may be formed to have a U-shaped cross section, and the protrusion 16*a* may be omitted.

The vent holes 10 are configured with straight-shaped first vent holes 10A formed on the inner open end portion 10*a* side and straight-shaped second vent holes 10B formed on the outer open end portion 10*b* side. The first vent holes 10A and the second vent holes 10B are disposed at positions shifted from each other in the radial direction. That is, the outer peripheral upper end surfaces of the first vent holes 10A and the inner peripheral lower end surfaces of the second vent holes 10B are connected to each other so as to form the vent holes 10, which are bent in a cross-sectional view. By this, a labyrinth structure is formed in which the pressure of water hardly directly acts on the filter F. In addition, the vent holes 10 may be formed in a straight shape, rather than being bent.

The respective first vent holes 10A are separated from each other by the convex portion 14*b* formed on the back surface of the columnar portion 14. In addition, a communication space 100 (an example of a space) is formed to allow the inner open end portions 10*a* of the respective first vent holes 10A to communicate with each other. The communication space 10C is formed between the convex portion 14*b* and the filter F, and is covered with the filter F. By this, even when water mixed with a foreign substance is introduced into any one vent hole 10, the foreign substance may be discharged from the other vent holes 10 through the communication space 100. Thus, it is possible to prevent deterioration in air permeability due to the foreign substance attached to the filter F. In addition, since the lid case 1*b* having the vent holes 10 may be manufactured using a lower mold for molding the first vent holes 10A and the communication space 100, and an upper mold for molding the second vent holes 10B, it is not necessary to use a special mold, which requires a complicated removal structure in order to form the vent holes 10 having a labyrinth structure.

Figure 4:
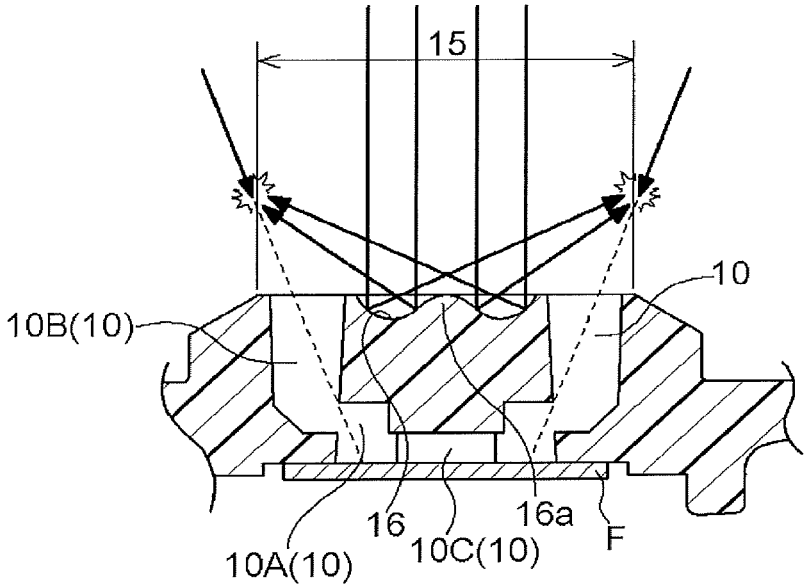
FIG. 4 is a conceptual view illustrating a state where the waterproof cover is directly hit by a liquid.

As illustrated in FIG. 4, when water directly hits the top plate portion 13 (the surface area 15) of the lid case 1*b*, the water is obliquely reflected along the curved surface of the concave portion 16. As a result, the water obliquely reflected from the concave portion 16 collides with the water to be introduced into the vent holes 10, whereby the pressure of water directly introduced into the vent holes 10 is canceled out and the amount of water is reduced. Therefore, the water directly hitting the filter F is reduced in pressure and amount, which may prevent the filter F from being damaged. In particular, when the protrusion 16*a* is provided in the central portion of the curved concave portion 16 as in the present embodiment, in addition to the water obliquely reflected from the outer peripheral surface of the concave portion 16, the water reflected by the protrusion 16*a* is also formed. As a result, since the water directly hitting the concave portion 16 is reflected at various angles, it is possible to further increase the probability of collision with the water to be introduced into the vent holes 10.

In practice, as a result of a high pressure water injection test carried out according to IS020653 IPX6K or IPX9K, the filter F was not damaged in the waterproof cover in the present embodiment. Meanwhile, when the concave portion 16 was not provided in the surface area 15, damage of the filter F was observed. In addition, the waterproof cover in the present embodiment also passed a predetermined ventilation test. Since the concave portion 16 does not protrude outward beyond the surface area 15 when performing the ventilation test, the ventilation test may be carried out in a state where an air supply unit (not illustrated) is in contact with the surface area, and the working efficiency of the ventilation test may be increased. In addition, in the present embodiment, since the lid case 1*b* is manufactured using simple upper and lower molds and it is sufficient for the filter F to be thermally welded to the inner surface of the lid case 1*b*, it is not necessary to assemble a separate component covering the vent holes 10, and it is possible to reduce manufacturing costs and to achieve compactness of a device.

Second Embodiment

Figure 5:
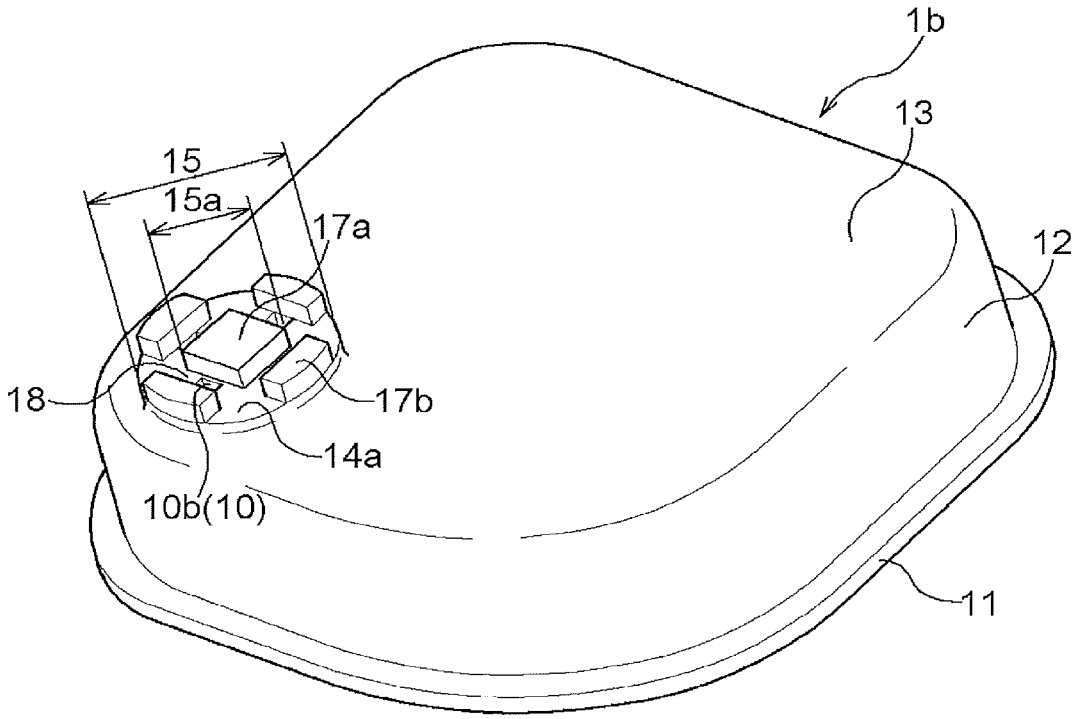
FIG. 5 is a perspective view of a waterproof cover according to a second embodiment.

A waterproof cover according to a second embodiment will be described with reference to FIG. 5. Since a basic configuration is the same as that of the above-described embodiment, only different configurations will be described with reference to the drawings. In addition, in order to facilitate the understanding of the drawings, a description will be made using the same member names and reference numerals as those in the above-described embodiment.

The region, which has a height different from that of the surface 14*a* formed in the surface area 15, is disposed in the central area 15*a* surrounded by the outer open end portions 10*b* of the plurality of vent holes 10, and is configured with a first wall portion 17*a*, which protrudes from a portion of the surface 14*a*, and a plurality of second wall portions 17*b* (at four positions in the present embodiment), which are provided on the radial outer side of the outer open end portions 10*b* of the respective vent holes 10 and around the first wall portion 17*a*, and protrude from portions of the surface 14*a*. The first wall portion 17*a* and the second wall portions 17*b* are formed in a quadrangular prism shape to protrude outward from the surface 14*a*. In addition, the end portions of the respective second wall portions 17*b* are spaced apart from each other, and have a plurality of air gaps (at four positions in the present embodiment). In other words, the respective vent holes 10 are separately disposed between the first wall portion 17*a* and the respective second wall portions 17*b*, and a rectangular communication path 18, through which water may flow, is formed between the first wall portion 17*a* and the second wall portions 17*b* and is connected to the air gaps. Thus, the water present in the communication path 18 passes through the air gaps and is discharged outward in the radial direction. In addition, either one of the first wall portion 17*a* and the second wall portions 17*b* may be omitted, or a single second wall portion 17*b* may be provided, without being particularly limited thereto.

When the region having a height different from that of the surface 14*a* is configured with the first wall portion 17*a* and the second wall portions 17*b* as in the present embodiment, since the plurality of wall portions 17*a* and 17*b* are present at different positions, the water directly hitting the first wall portion 17*a* and the second wall portions 17*b* is reflected at various angles. As a result, it is possible to increase the probability of collision between the water reflected from the first wall portion 17*a* and the second wall portions 17*b* and the water to be introduced into the vent holes 10. Moreover, since the end portions of the second wall portions 17*b* are spaced from each other, the water reflected from the first wall portion 17*a* or the second wall portions 17*b* or the water colliding with the reflected water to thereby be introduced into the vent holes 10 may be discharged outward from the air gaps through the communication path 18. Thus, it is possible to reduce the pressure and the amount of the water directly hitting the filter F. Moreover, since the water flowing through the communication path 18 is promptly discharged from the air gaps, no water accumulates around the vent holes 10.

In practice, as a result of a high pressure water injection test carried out according to IS020653 IPX6K or IPX9K, the filter F was not damaged in the waterproof cover in the present embodiment. Other acting effects are the same as those in the above-described embodiment, and thus a description thereof will be omitted.

Other Embodiments

Other embodiments will be described below with reference to FIGS. 6 to 9. Since a basic configuration is the same as that of the above-described embodiment, only different configurations will be described with reference to the drawings. In addition, in order to facilitate understanding of the drawings, a description will be made using the same member names and reference numerals as those in the above-described embodiment.

Figure 6:
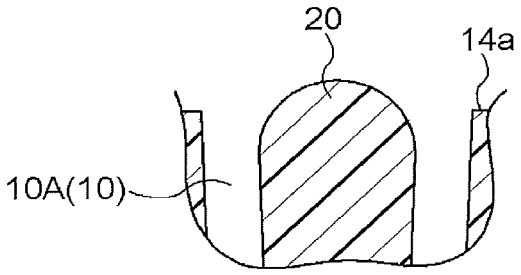
FIG. 6 is an enlarged cross-sectional view of a surface area according to another embodiment 1.

(1) Instead of the concave portion 16 of the first embodiment, as illustrated in FIG. 6, the region having a height different from the surface 14*a* may be configured by a curved convex portion 20, which protrudes in a curved shape from a portion of the surface 14*a*. In addition, the curved convex portion 20 may not be formed in a curved surface, but may be formed in a polygonal cross section having a plurality of edges.

Figure 7:
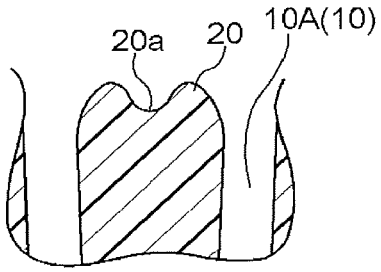
FIG. 7 is an enlarged cross-sectional view of a surface area according to another embodiment 2.

(2) As illustrated in FIG. 7, a concave portion 20*a*, which is recessed in the central portion of the curved convex portion 20, may be provided.

Figure 8:
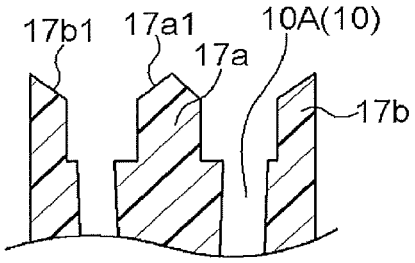
FIG. 8 is an enlarged cross-sectional view of a surface area according to another embodiment 3.

(3) As a modification of the second embodiment, as illustrated in FIG. 8, a first inclined surface 17*a*1, the height of which decreases toward the vent hole 10, may be formed on the tip end of the first wall portion 17*a*. In addition, a second inclined surface 17*b*1, the height of which decrease toward the vent hole 10, may be formed on the tip end of the second wall portion 17*b*.

Figure 9:
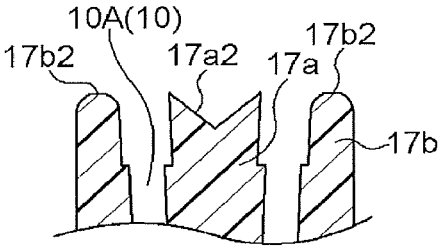
FIG. 9 is an enlarged cross-sectional view of a surface area according to another embodiment 4.

(4) As illustrated in FIG. 9, a third inclined surface 17*a*2, the height of which increases toward the vent holes 10, may be formed on the tip end of the first wall portion 17*a*. In addition, an arc surface 17*b*2 may be formed on the tip ends of the second wall portions 17*b*. In addition, the region having a height different from that of the surface 14*a* may have an appropriately combined shape of the shapes according to the above-described embodiments, without being particularly limited thereto.

(5) The waterproof cover according to the present embodiment is not limited to be used in the electric pump P, and may be suitably used so long as it covers an electronic component such as an oil pump or a transmission.

A feature of a configuration of a waterproof cover according to an aspect of this disclosure resides in that the waterproof cover includes a lid unit having a vent hole which allows an inner surface and an outer surface to communicate with each other, and configured to cover an electronic component; and a filter fixed to the inner surface of the lid unit in a state of facing an inner open end portion of the vent hole, and configured to block flow of a liquid while allowing air to flow therethrough. The outer surface of the lid unit has a surface area including a surface in which an outer open end portion of the vent hole is exposed, and the surface area has a region formed at a position adjacent to the vent hole and having a height different from a height of the surface.

In this configuration, a region, which has a height different from that of the surface having the outer open end portion of the vent hole, is formed at a position adjacent to the vent hole in the surface area is formed on the outer surface of the lid unit. Thus, when a liquid directly hits the lid unit, some of the liquid is reflected from the region having the different height, and the reflected liquid collides with the liquid to be directly introduced into the vent hole. As a result, the pressure of the liquid to be directly introduced into the vent hole is canceled out, and the pressure and amount of the liquid, which is introduced into the vent hole and directly hits the filter, are reduced. Thus, the filter can be prevented from being damaged due to the liquid directly hitting the filter.

In addition, with a simplified configuration in which the region having the different height is provided in the surface area as in this configuration, since it is not necessary to assemble a separate component covering the vent hole, it is possible to reduce a manufacturing cost and to prevent an increase in the size of a device. Moreover, due to the configuration in which the pressure of the liquid is reduced on the outer surface side of the lid unit, it is not necessary to configure the vent hole in a complicated shape in order to reduce the pressure of the liquid, and the lid unit may be manufactured using a simplified mold, which is divided into upper and lower molds.

In this way, a waterproof cover capable of reliably preventing damage to the filter with a simple configuration can be provided.

In another configuration, the region having the different height may be configured with a concave portion, which is recessed in a curved shape in a portion of the surface.

When the region having the different height is configured by the concave portion recessed in a portion of the surface as in this configuration, the region can be easily processed. In addition, since the concave portion does not protrude outward, the device is not enlarged. Moreover, when the concave portion is formed in a curved shape, since the liquid directly hitting the concave portion is reflected obliquely from the curved surface as a reflection surface, the probability of the obliquely reflected liquid colliding with the liquid to be directly introduced into the vent hole is increased. Thus, the pressure and amount of the liquid directly hitting the filter can be reliably reduced.

In another configuration, a plurality of the vent holes may be disposed along an outer peripheral direction of the concave portion, and the concave portion may have a protrusion formed in a central portion thereof.

In this configuration, since a plurality of the vent holes are formed, air permeability is good. In addition, when the protrusion is provided in the central portion of the curved concave portion as in this configuration, in addition to the liquid obliquely reflected from the curved surface in the vicinity of the outer periphery of the concave portion, the liquid obliquely reflected from the curved surface in the vicinity of the protrusion may collide with the liquid to be directly introduced into the vent hole. As a result, the probability of the liquid obliquely reflected from the curved surface colliding with the liquid to be introduced into the vent hole can be further increased, and the pressure and the amount of the liquid directly hitting the filter can be further reduced.

In another configuration, the region having the different height may be configured with a first wall portion which protrudes from a portion of the surface, and a plurality of second wall portions which are disposed around the first wall portion and protrude from a portion of the surface. The vent holes are separately disposed between the first wall portion and the respective second wall portions.

In this configuration, since the vent holes are separately disposed between the first wall portion and the respective second wall portions, a plurality of the vent holes exist and air permeability is good. In addition, as in this configuration, when the region having the different height is constituted with the first wall portion and the plurality of second wall portions disposed around the first wall portion, since a plurality of wall portions are present at different positions, the liquid directly hitting the first wall portion and the second wall portions is reflected at various angles. As a result, the probability of the liquid reflected by the first wall portion and the second wall portions colliding with the liquid to be introduced into the vent hole disposed between the first wall portion and the second wall portions can be further increased. Moreover, since the plurality of second wall portions are disposed around the first wall portion, an air gap can be formed between the respective adjacent second wall portions, and the liquid reflected from the first wall portion or the second wall portions or the liquid colliding with the reflected liquid to thereby be introduced into the vent hole can be discharged from the air gap to the outside. Thus, the pressure and the amount of the liquid directly hitting the filter can be more reliably reduced.

In another configuration, a plurality of the vent holes may be disposed, and the inner open end portions of respective vent holes may communicate with each other by a space formed between the inner open end portions and the filter.

When the inner open end portions of the respective vent holes communicate with each other by the space formed between the inner open end portions and the filter as in this configuration, even if a foreign substance mixed in the liquid is introduced into any vent hole, the foreign substance can be discharged from the other vent holes through the space. Thus, air permeability can be prevented from deteriorating due to the foreign substance attached to the filter.

This disclosure may be applied in a waterproof cover that seals electronic components of various devices.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A waterproof cover comprising:

a lid unit having at least one vent hole which allows an inner surface and an outer surface to communicate with each other, and configured to cover an electronic component; and a filter fixed to the inner surface of the lid unit in a state of facing an inner open end portion of the at least one vent hole, and configured to block flow of a liquid while allowing air to flow therethrough, wherein the outer surface of the lid unit has a surface area including a surface in which an outer open end portion of the at least one vent hole is exposed along a same plane as the outer surface of the lid, and wherein the surface area of the outer surface has a region formed at a position adjacent to the at least one vent hole at a position outside of the at least one vent hole, the region having a height different from a height of the outer surface wherein the region having the different height is configured with a concave portion, which is recessed in a curved shape in a portion of the outer surface, and wherein a plurality of the vent holes are disposed along an outer peripheral direction of the concave portion, and the concave portion has a protrusion formed in a central portion thereof.

2. The waterproof cover according to claim 1, wherein the region having the different height is configured with a first wall portion which protrudes from a portion of the outer surface, and a plurality of second wall portions which are disposed around the first wall portion and protrude from a portion of the outer surface, and wherein a plurality of the vent holes are disposed along an outer peripheral direction of the concave portion, the plurality of vent holes are separately disposed between the first wall portion and the respective second wall portions.

3. The waterproof cover according to claim 1, wherein a plurality of the vent holes are disposed, and the inner open end portions of respective vent holes communicate with each other by a space formed between the inner open end portions and the filter.

4. The waterproof cover according to claim 2, wherein the inner open end portions of respective vent holes communicate with each other by a space formed between the inner open end portions and the filter.

* * * * *